US012529169B2

(12) United States Patent
Caridi

(10) Patent No.: US 12,529,169 B2
(45) **Date of Patent: *Jan. 20, 2026**

(54) TERRY FABRIC HAVING FACES WITH VARYING WEIGHT

(71) Applicant: Sobel Westex, Las Vegas, NV (US)

(72) Inventor: Roberto Caridi, New York, NY (US)

(73) Assignee: Sobel Westex, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/741,601

(22) Filed: Jun. 12, 2024

(65) Prior Publication Data

US 2024/0392482 A1 Nov. 28, 2024

Related U.S. Application Data

(63) Continuation-in-part of application No. 16/784,107, filed on Feb. 6, 2020, now Pat. No. 12,037,721.

(60) Provisional application No. 62/802,026, filed on Feb. 6, 2019.

(51) Int. Cl.
*D03D 27/08* (2006.01)
*D03D 1/00* (2006.01)

(52) U.S. Cl.
CPC ..... *D03D 27/08* (2013.01)

(58) Field of Classification Search
CPC .... D03D 27/08; D03D 13/008; D03D 1/0017; D03D 2700/0177; D03D 15/43
See application file for complete search history.

(56) References Cited

U.S. PATENT DOCUMENTS 1,831,812 A * 11/1931 Leach ..... D03D 27/00 28/166
2,546,261 A * 3/1951 Groat ..... D03D 39/10 139/403
2,814,314 A * 11/1957 Harding ..... D03D 27/06 139/39
RE24,949 E * 3/1961 Clark ..... D03D 27/06 139/46
2,997,074 A * 8/1961 Law ..... D03D 27/08 139/396
3,030,691 A * 4/1962 Law ..... D03D 27/08 428/95
3,302,665 A * 2/1967 McHargue ..... D03D 27/08 139/396
3,343,242 A * 9/1967 De Witte ..... D06P 5/001 28/169
3,721,272 A * 3/1973 Hager ..... D03D 27/08 26/69 R
3,721,273 A * 3/1973 Sherrill ..... D03D 27/08 26/69 R
3,721,274 A * 3/1973 Sherrill ..... D03D 27/08 26/69 R
4,415,611 A * 11/1983 Yamagata ..... D04H 11/00 28/162

(Continued)

*Primary Examiner* — Robert H Muromoto, Jr.
(74) *Attorney, Agent, or Firm* — Howard & Howard Attorneys PLLC

(57) ABSTRACT

A terry fabric includes a top face having a first number of yarn loops and a first pile weight, and a bottom face opposite the top face having a second number of yarn loops and a second pile weight, wherein the first number of yarn loops is different than the second number of yarn loops and the first pile weight is different than the second pile weight.

20 Claims, 5 Drawing Sheets

(56) References Cited

U.S. PATENT DOCUMENTS 4,525,403 A * 6/1985 Hynek ..... D06N 3/004 451/28
4,624,675 A * 11/1986 Irmer ..... D03D 27/00 8/138
4,670,317 A * 6/1987 Greenway ..... D06C 23/00 428/152
4,726,400 A * 2/1988 Heiman ..... D03D 27/08 139/396
5,447,182 A * 9/1995 Gehrig ..... D03D 27/08 139/396
5,667,865 A * 9/1997 Jackson ..... D03D 27/08 8/537
5,722,465 A * 3/1998 Herrlein ..... D03D 39/223 139/26
5,894,743 A * 4/1999 Bredemeyer ..... D04B 23/08 66/84 R
5,966,757 A * 10/1999 Sullivan ..... A47G 9/062 5/419
6,062,272 A * 5/2000 Waite ..... D03D 27/00 428/92
6,063,473 A * 5/2000 Zafiroglu ..... B29C 70/24 428/95
6,112,773 A * 9/2000 Geiger ..... D03D 39/226 139/26
6,305,431 B1 * 10/2001 Fenkes ..... A47L 13/16 139/391
6,546,965 B2 * 4/2003 Hamby ..... D03D 27/08 139/420 A
7,044,173 B2 * 5/2006 Silver ..... A47K 10/02 139/420 R
7,067,184 B1 * 6/2006 Carkeek ..... A47G 23/03 428/101
7,565,821 B2 * 7/2009 Park ..... B60N 2/976 66/195
7,601,655 B2 * 10/2009 Katsin ..... B32B 5/06 428/92
7,673,656 B2 * 3/2010 Heiman ..... D03D 27/08 139/420 R
7,850,741 B2 * 12/2010 Park ..... D03D 15/283 57/332
8,578,972 B2 * 11/2013 Duan ..... D03D 15/33 139/420 R
8,596,305 B2 * 12/2013 Govindaswamy ..... D03D 15/68 139/420 R
8,631,833 B2 * 1/2014 Garbarino ..... D06H 5/00 139/420 R
9,044,917 B1 * 6/2015 Terracino ..... A47G 27/0206
9,828,704 B2 * 11/2017 Goenka ..... D03D 27/08
9,850,599 B2 * 12/2017 Stewart ..... D03D 27/08
10,072,364 B2 * 9/2018 Goenka ..... D03D 27/08
10,655,251 B2 * 5/2020 Dalton ..... B32B 7/12
11,408,100 B2 * 8/2022 Vanunu ..... D03D 27/08
12,037,721 B2 * 7/2024 Caridi ..... D03D 1/0017
2002/0122914 A1 * 9/2002 Rock ..... D04B 1/02 428/85
2002/0124365 A1 * 9/2002 Wood ..... D06C 29/00 28/162
2003/0024093 A1 * 2/2003 Willauer, Jr. ..... D06C 23/00 28/169
2003/0089097 A1 * 5/2003 Lee ..... D02G 3/38 57/3
2004/0086683 A1 * 5/2004 Higgins ..... D06N 7/0086 428/95
2005/0081938 A1 * 4/2005 Krumm ..... D03D 39/226 139/25
2011/0017341 A1 * 1/2011 Terracino ..... A47G 27/0206 139/383 R
2011/0111666 A1 * 5/2011 Kim ..... D03D 15/47 112/439
2012/0208416 A1 * 8/2012 Lerman ..... A47G 27/0225 442/1
2012/0255643 A1 * 10/2012 Duan ..... D03D 15/33 66/93
2013/0115841 A1 * 5/2013 Ronner ..... D06C 15/02 28/165
2014/0255643 A1 * 9/2014 Koot ..... B32B 5/024 428/86
2014/0317865 A1 * 10/2014 Krishna ..... D03D 15/573 15/209.1
2015/0291074 A1 * 10/2015 Taguchi ..... D06N 7/0065 428/89
2017/0073858 A1 * 3/2017 Goenka ..... D03D 1/0017
2018/0155868 A1 * 6/2018 Michinobu ..... D06M 15/643
2020/0232128 A1 * 7/2020 Lawrence ..... D03D 15/47
2020/0248345 A1 * 8/2020 Caridi ..... D03D 1/0017

* cited by examiner

TECHNICAL CARD

400

| SAMPLE | MEASURES IN CMS | BORDER |
|---|---|---|
| SMART TOWEL 2 | 71 X 147 | 209 |

| | | |
|---|---|---|
| #REED | 12 | |
| GROUND WARP COUNT | 10/1 OE COTTON | |
| PILE WARP WARP | 16/1SOFT SPUN COTTON | |
| UP PILE PICKS | 1420 | 16/1 OE COTTON WEFT |
| BACK PILE PICKS | 710 | 12/1 OE COTTON WEFT |
| | 12/1 COTTON | |
| 2 EXTREME BORDER PICKS | 108 108 OPEN END | |
| | 54 54 24/2POLY | |
| EXTREME BORDER FINISH WIDTH | 2.0 CMS | |
| PICK BORDER 1 | | |
| PICK BORDER 2 | | |
| PICK BORDER 3 | | |
| EXTREME BORDER WIDTH 1 | 2.5 CMS | |
| EXTREME BORDER WIDTH 2 | 2.5 CMS | |
| SEPARATION PICKS | 24 6 24 | 16/1 OE COTTON |
| TOTAL PICKS | 2508 | |
| PICKS PER CMS | 14.1 | |
| WIDTH REED | 254.8 | |
| #GROUND WARP | 3298 ENDS | |
| #TOP PILE ENDS | 2120 ENDS | 402 |
| #BOTTOM PILE ENDS | 706 ENDS | 404 |
| TOTAL PILE WARP | 2826 ENDS | |
| SELVAGE # ENDS | 76 X 6 | |
| UNIT WEIGHT (GRAMS) | 631 | |
| FINISHING WEIGHT | 574 | |
| WEIGHT GRMS / M2 | 550 | |
| UNITS TO THE LOOM WIDTH | 3 | |
| REMARKS | STRAIGHT DRAWING-IN | |

FIG. 4

500

| | NE. | COUNT. | WEIGHT PILE | WEFT HIGHT | WEIGHT GROUND | TOTAL FRONT WEIGHT | TOTAL BOTTOM WEIGHT |
|---|---|---|---|---|---|---|---|
| PILE TOP SURFACE | 16/1 | 16 | 300 | 93 | 124 | 817 | 417 |
| PILE BOTTOM SURFACE | 16/1 | 16 | 100 | | | | |

| COUNT | PILE WEIGHTS | POUNDS/ DOZEN | GRAMS /M2 |
|---|---|---|---|
| NE. 16/1 OE SOFTS | FRONT WEIGHT | 22 | 783 |
| NE. 16/1 OE SOFTS | BOTTOM WEIGHT | 11 | 400 |
| REAL WEIGHT | | 16 | 530 |

FIG. 5

TERRY FABRIC HAVING FACES WITH VARYING WEIGHT

CROSS-REFERENCE TO RELATED APPLICATION(S)

The present application is a Continuation-In-Part of U.S. Ser. No. 16/784,107, filed Feb. 6, 2020, which claims the benefit of U.S. Provisional Ser. No. 62/802,026, filed Feb. 6, 2019, the entire disclosure of both being incorporated by reference.

BACKGROUND OF THE INVENTION

1. Field of the Invention

The present invention relates generally to fabrics and, more specifically, to a terry fabric having faces with varying weight.

2. Description of Related Art

Terry fabrics have traditionally been used for making towels due to their durability and ability to absorb water. However, terry fabrics are difficult and expensive to launder because of these qualities. Laundering terry fabrics effectively calls for significant amounts of detergent, water, and heat or drying time compared to other fabrics. To overcome these challenges, it has been desirable to reduce the overall weight of the fabric, and thus, the weight of the towel. However, in traditional terry fabrics, the weight of pile is distributed evenly between the two faces of the fabric, i.e., 50% pile weight on one face of the fabric and 50% pile weight on the opposite face of the fabric. In other designs, a single face of the fabric may have pile weight distributed differently (e.g., in bands with varying pile weights across the face of the fabric). However, this affects the overall appearance and feel of the fabric, and it also limits the versatility of the fabric during manufacturing by, for example, limiting what borders might be used on the fabric based on the pile weight distribution.

The present invention is aimed at solving one or more of the problems identified above.

SUMMARY OF THE INVENTION

Accordingly, the present invention provides a terry fabric including a top face having a first number of yarn loops and a first pile weight, and a bottom face opposite the top face having a second number of yarn loops and a second pile weight, wherein the first number of yarn loop is different that the second number of yarn loops and the first pile weight is different than the second pile weight.

In addition, the present invention provides a method of making a terry fabric including the steps of providing a pile yarn, and weaving the bottom pile yarn together with a top pile yarn to form a terry fabric having a top face opposite a bottom face, wherein the top face has a first number of yarn loops and a first pile weight and the bottom face has a second number of yarn loops and a second pile weight, wherein the first pile weight is different than the second pile weight.

One advantage of the present invention is that a terry fabric is provided having a different number of yarn loops or ends on each face, and thus a different weight, on each face of the fabric. Another advantage of the present invention is that the terry fabric achieves a high-volume appearance towel with a low overall weight. Yet another advantage of the present invention is that the terry fabric provides effective absorption on the top face, which may be used primarily for drying, while the bottom face may be used for rubbing or other action that requires more friction.

Advantages of the present invention will be readily appreciated, as the same becomes better understood by reference to the following detailed description, when considered in connection with the accompanying drawings.

BRIEF DESCRIPTION OF THE DRAWINGS

Non-limiting and non-exhaustive embodiments of the present invention are described with reference to the following figures, wherein like numerals refer to like parts throughout the various views unless otherwise specified.

FIG. 4 is a technical card including specifications of the representative towel with the terry fabric construction of FIG. 1.

FIG. 5 is a table including weight calculations based on the specifications of the technical card of FIG. 4.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example", or "an examples" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

The present disclosure particularly describes a terry fabric having a different number of yarn loops or ends, and thus different weight, on each face of the fabric. Despite the differing number of yarn loops and weight on each face of the fabric, the fabric may have the same pile height on both faces. Thus, the fabric of the present invention achieves a high-volume appearance towel with low overall weight. This construction provides effective absorption on the top face, which may be used primarily for drying, while the bottom face may be used for rubbing or other action that requires more friction. These two different faces are provided in a single towel, fulfilling the complete purpose for which a towel is needed. The low overall weight of the fabric decreases the cost of laundering articles made of the fabric. However, the face of the fabric used for drying feels luxurious to the user, so the user experience is not negatively affected. Additionally, the fabric remains versatile for manufacturing purposes. For example, any border may be used on an article made from the fabric because the weight is consistent across a single face of the fabric.

Figure 1:
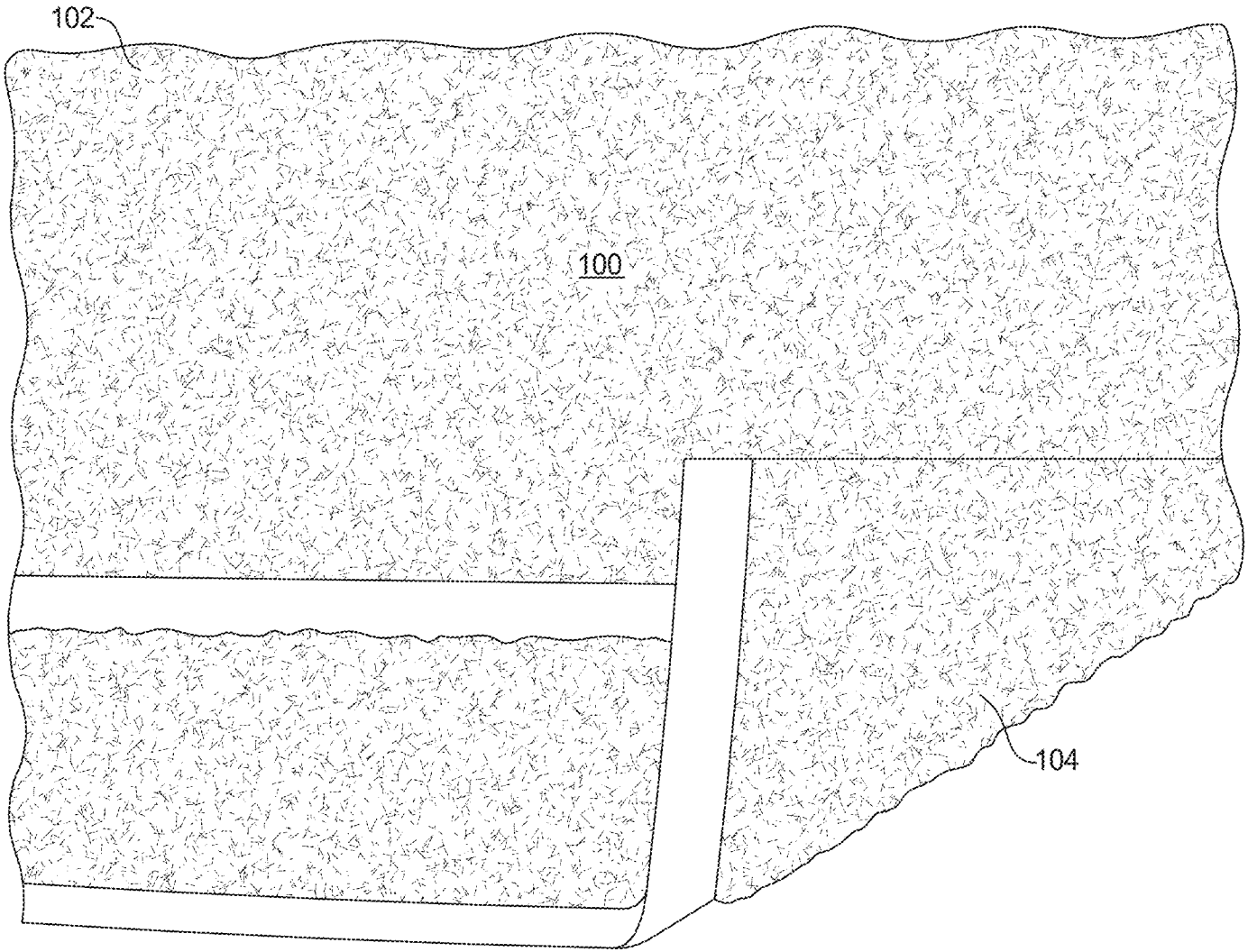
FIG. 1 is a perspective view of a partial representative towel with a terry fabric construction according to one embodiment of the present invention.

Referring now to FIG. 1, a perspective view of a representative towel 100 with a terry fabric construction, according to one embodiment of the present invention, is shown. With this fabric construction, the faces of the towel 100 appear to have different volumes, rather than a uniform volume on both faces of the fabric. This is possible by using the same yarn on a top face 102 and on a bottom face 104. However, it should be appreciated that, in other embodiments, a fabric construction may be used such that faces of the towel 100 appear to have the same volume, despite varying differing number of yarn loops or ends on each face. This is achieved by using a fabric with the same pile height on both faces 102, 104.

Figure 2:
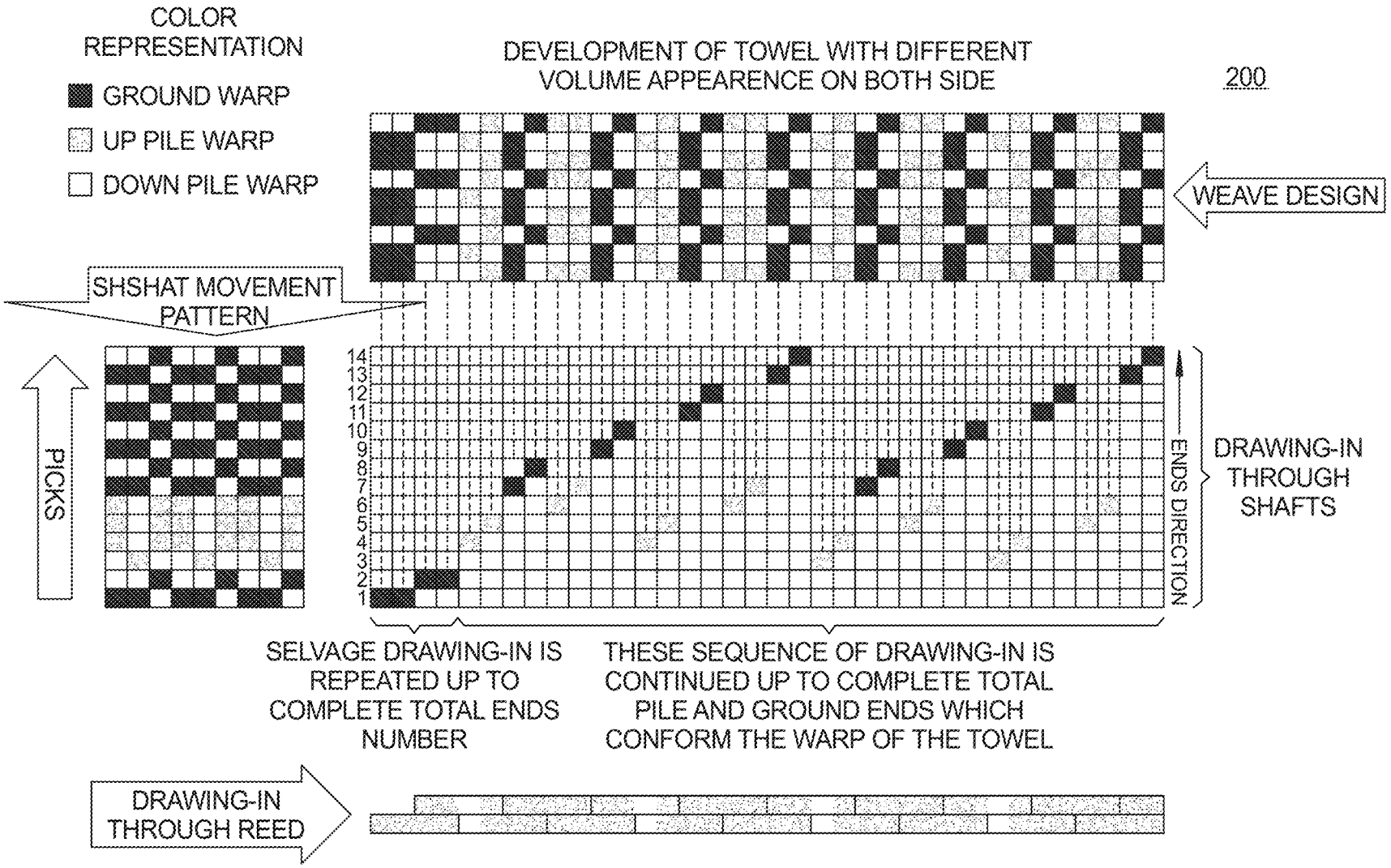
FIG. 2 is a weave design schematic according to the terry fabric construction of FIG. 1.

Referring now to FIG. 2, a weave design schematic 200, according to one embodiment of the present invention, is shown. The weave design schematic 200 includes a weave design, pattern or shaft movement order, draw-in on shaft, and reed. Ground ends are disposed with a straight draw, allowing a variety of designs on borders, just by modifying the pattern on this area of the fabric.

Figure 3:
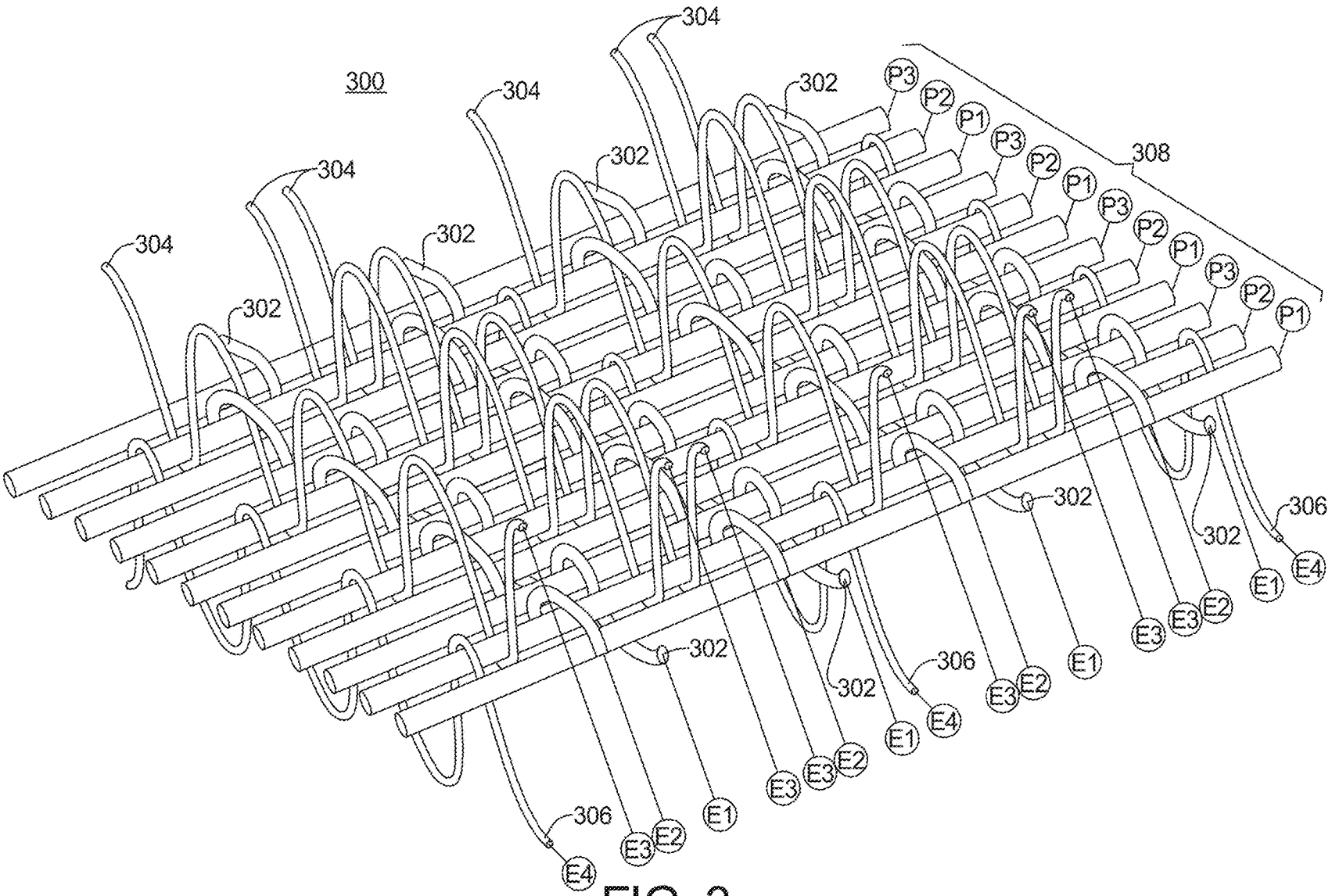
FIG. 3 is a partial, three-dimensional, not-to-scale view of the weave components of the terry fabric construction of FIG. 1.

Referring now to FIG. 3, a partial, three-dimensional, not-to-scale view of a weave of the terry fabric construction according to FIG. 1 is shown. The weave 300 is a three-pick pile cycle terry weave. Ground warp ends E1 and E2 are made of a first yarn 302. Top pile end E3 is made of a second yarn 304. Bottom pile end E4 is made of a third yarn 306. Ground fill picks P1, P2, and P3 are made of a fourth yarn 308. It should be appreciated that, in some embodiments, the second yarn 304 and the third yarn 306 may be the same type of yarn.

Referring now to FIG. 4, a technical card 400 including specifications of the towel 100 of FIG. 1 is shown. The technical card 400 meets main specifications of the towel 100, which determines length, width, and weight. It also contains the type of ends used on the warp and weft, and their respective densities. For example, in the illustrated embodiment, the top pile yarn (e.g., second yarn 304 of FIG. 3) and the bottom pile yarn (e.g., third yarn 306 of FIG. 3) are both 16*s* cotton yarn. However, a density of the top pile yarn may be higher than a density of the bottom pile yarn, or vice versa. In the illustrated embodiment, the top pile yarn (2120 yarn loops or ends) has a density 402 that is approximately three times a density 404 of the bottom pile yarn (706 yarn loops or ends). It should be appreciated that the top face 102 has a pile density that is different from the pile density of the bottom face 104.

It will be understood that the specifications on the technical card 400 could be modified depending on the desired final weight and dimension of the towel 100. It should be appreciated that the specifications shown in FIG. 4 are for illustrative purposes only and are in no way limiting.

Referring now to FIG. 5, a table 500 including weight calculations based on the specifications of the technical card 400 of FIG. 4 is shown. In the illustrated embodiment, the table 500 shows the final, real weight of the towel 100 is sixteen (16) pounds per dozen (or 530 g/m$^2$), with a front or top face weight of 22 pounds per dozen (or 783 g/m$^2$) and a back or bottom face weight of eleven (11) pounds per dozen (or 400 g/m$^2$), based on the use 16s cotton yarns for the top and bottom pile yarns, with the top pile yarn having a pile weight of three hundred (300) and the bottom pile yarn having a pile weight of one hundred (100). Thus, the real weight of the towel 100 is less than the weight of the heavier surface (if the towel 100 were made entirely of the heavier surface material) but greater than the weight of the lighter surface (if the towel 100 were made entirely of the lighter surface material). Therefore, although the overall weight of the towel 100 is about sixteen (16) pounds, it has the quality of an approximately 22-pound towel on one face and an approximately 11-pound towel on the reverse or opposite face. Thus, the towel 100 may be sold having the value of a 22-pound towel for the price of a 16-pound towel. It should be appreciated that the top face 102 has a pile weight that is different from the pile weight of the bottom face 104. It should also be appreciated that the towel 100 is a terry fabric having an overall weight less than two times the surface weight of the top face 102 and an overall weight greater than the surface weight of the bottom face 104. It should further be appreciated that a combined weight of the top face 102 and the bottom face 104 of the terry fabric is less than two times the first pile weight but greater than the second pile weight.

It will be understood that the calculations in table 500 are based on specifications of technical card 400 of FIG. 4, and that such calculations would change as the specifications of technical card 400 are modified. For example, the desired overall weight of the towel 100 (or other article) may be more or less than sixteen (16) pounds, as shown, and therefore varying the desired overall weight of the towel 100 would require adjustments of all other values, all of which may be completely customizable. The calculations shown in FIG. 5 are for illustrative purposes only and are in no way limiting. By way of example and not limitation, additional embodiments could include the following:

(1) Use of 12s cotton yarn for top pile yarn and bottom pile yarn with a 3-to-1 number of yarn loops (wherein the top pile has three times the yarn loops as the bottom pile);

(2) Use of 12s cotton yarn for top pile yarn, and 15s cotton yarn for bottom pile yarn with a 3-to-1 density differential (wherein the top pile yarn is three times as dense as the bottom pile yarn); and (3) Use of 15s cotton yarn for top pile yarn, and 12s cotton yarn for bottom pile yarn with a 3-to-1 density differential (wherein the top pile yarn is three times as dense as the bottom pile yarn).

It should be appreciated that the top pile yarn and bottom pile yarn have different number of yarn loops or ends and varying densities.

While the foregoing descriptions have discussed towels, it should be recognized that the fabric of the present invention may be used for any suitable linen or item of manufacture for which terry cloth is or could be used.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the present invention and also to enable any person skilled in the art to practice the embodiments, including making and using any articles or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A terry fabric comprising:

a top face having a first number of yarn loops throughout and a first pile weight; and a bottom face opposite the top face having a second number of yarn loops throughout and a second pile weight, wherein:

the first number of yarn loops is different than the second number of yarn loops; and the first pile weight is different than the second pile weight.

2. The terry fabric of claim 1, wherein the first pile weight is greater than the second pile weight.

3. The terry fabric of claim 1, wherein the first number of yarn loops is greater than the second number of yarn loops.

4. The terry fabric of claim 1, wherein the second number of yarn loops is greater than the first number of yarn loops.

5. The terry fabric of claim 1, wherein the top face and the bottom face are made of the same yarn.

6. The terry fabric of claim 1, wherein the top face and the bottom face are made of different yarns.

7. The terry fabric of claim 6, wherein the first yarn is a coarser yarn than the second yarn.

8. The terry fabric of claim 1, wherein the terry fabric has an overall weight, wherein the overall weight is less than two times the first pile weight.

9. The terry fabric of claim 1, wherein the terry fabric has a combined weight of the top surface and the bottom surface of the terry fabric is less than two times the first pile weight but greater than the second pile weight.

10. The terry fabric of claim 1, wherein the top surface has a first pile height and the bottom surface has a second pile height, wherein the first pile height is equal to the second pile height.

11. A method of making a terry fabric, the method comprising steps of:

providing a pile yarn; and weaving the bottom pile yarn together with a top pile yarn to form a terry fabric having a top face opposite a bottom face, wherein the top face has a first number of yarn loops throughout and a first pile weight and the bottom face has a second number of yarn loops throughout and a second pile weight, wherein the first pile weight is different than the second pile weight.

12. The method of claim 11, wherein the first pile weight is greater than the second pile weight.

13. The method of claim 11, wherein the second pile weight is greater than the first pile weight.

14. The method of claim 11, wherein the first number of yarn loops is greater than the second number of yarn loops.

15. The method of claim 11, wherein the top face and the bottom face are made of the same yarn.

16. The method of claim 11, wherein the top face and the bottom face are made of different yarns.

17. The method of claim 16, wherein the first pile yarn is a coarser yarn than the second pile yarn.

18. The method of claim 11, wherein the terry fabric has a combined weight of the top surface and the bottom surface of the terry fabric is less than two times the first pile weight but greater than the second pile weight.

19. The method of claim 11, wherein the top face has a first pile height and the bottom face has a second pile height, wherein the first pile height is equal to the second pile height.

20. A terry fabric comprising:

a top face comprising a first yarn having a first number of yarn loops throughout, the top face further having a first pile weight; and a bottom face comprising a second yarn having a second number of yarn loops throughout, the bottom face further having a second pile weight, wherein:

the first number of yarn loops is greater than the second number of yarn loops;

the first pile weight is greater than the second pile weight;

the first yarn is the same as the second yarn; and the terry fabric has an overall weight, wherein the overall weight is less than two times the first pile weight and greater than two times the second pile weight.

* * * * *